US008544301B2

(12) United States Patent
Nave

(10) Patent No.: US 8,544,301 B2
(45) Date of Patent: Oct. 1, 2013

(54) COMBINATION LOCK

(75) Inventor: Zachery Nave, Oak Creek, WI (US)

(73) Assignee: Master Lock Company LLC, Oak Creek, WI (US)

( * ) Notice: Subject to any disclaimer, the term of this patent is extended or adjusted under 35 U.S.C. 154(b) by 1110 days.

(21) Appl. No.: 11/766,462

(22) Filed: Jun. 21, 2007

(65) Prior Publication Data

US 2008/0314093 A1 Dec. 25, 2008

(51) Int. Cl.
*E05B 37/10* (2006.01)

(52) U.S. Cl.
USPC ..... 70/21; 70/24; 70/25

(58) Field of Classification Search
USPC ..... 70/21–22, 24–25, 332, 284, 285
See application file for complete search history.

(56) References Cited

U.S. PATENT DOCUMENTS

| | | | | |
|---|---|---|---|---|
| 427,421 | A | 5/1890 | Jackson | |
| 747,116 | A | 12/1903 | Amstalden | |
| 1,583,402 | A | 5/1926 | Lewis | |
| 1,674,901 | A | 6/1928 | Ibarrart | |
| 2,078,168 | A | 4/1937 | Stone et al. | |
| 3,611,761 | A | 10/1971 | Atkinson | |
| 3,766,758 | A | 10/1973 | Heine et al. | |
| 3,983,724 | A | 10/1976 | Foote | |
| 4,100,775 | A | 7/1978 | Bako | |
| 4,557,122 | A | 12/1985 | Hwang | |
| 4,895,036 | A | 1/1990 | Larson et al. | |
| 5,237,842 | A | 8/1993 | Rasch et al. | |
| 6,708,534 | B1 * | 3/2004 | Ruan | 70/38 A |
| 6,845,643 | B2 | 1/2005 | Tsai | |
| 6,877,345 | B1 | 4/2005 | Misner et al. | |
| 6,883,355 | B2 * | 4/2005 | Lai | 70/25 |
| 6,955,069 | B2 | 10/2005 | Segawa et al. | |
| 7,467,531 | B2 * | 12/2008 | Lai et al. | 70/38 C |
| 2003/0136160 | A1 | 7/2003 | Segawa | |
| 2004/0134242 | A1 | 7/2004 | Wyers | |
| 2006/0169007 | A1 * | 8/2006 | Fiegener | 70/25 |

FOREIGN PATENT DOCUMENTS

CN 2828251 10/2006

OTHER PUBLICATIONS

International Search Report and Written Opinion from International Application No. PCT/US08/67439 mailed Sep. 29, 2008.
Office Action from Chinese Patent Application No. 200710300489.4, date of issue Jun. 3, 2011.
Office Action from U.S. Appl. No. 11/952,578, dated Feb. 4, 2013.

* cited by examiner

*Primary Examiner* — Kristina Fulton
(74) *Attorney, Agent, or Firm* — Calfee, Halter & Griswold LLP

(57) ABSTRACT

A combination lock includes a locking mechanism, a plurality of dials, and a code identifying member. When each of the plurality of dials is rotated to an unlocking orientation, a recess on each of the dials aligns with a portion of the locking mechanism, allowing the locking mechanism to move from a locked condition to an unlocked condition. When the code identifying member is in a dial engaging position, and one of the plurality of dials is rotated to the unlocking orientation, one of a plurality of dial engaging portions of the code identifying member engages the recess of the one of the plurality of dials to provide a perceptible indication that the one of the plurality of dials is in the unlocking orientation.

10 Claims, 7 Drawing Sheets

COMBINATION LOCK

BACKGROUND

Combination locks are used in commercial, residential, and institutional environments to provide lockable access to personal items and/or enclosures. The combination lock may be a separate device, such as a combination padlock, which may be shackled to a door, bracket, cable, or other item to restrict access. Alternatively, the combination lock may be integral to an enclosure, such as a safe or a storage locker. Combination locks include single-dial and multiple-dial designs.

While the use of a combination lock, as compared to a key based lock, may eliminate the risk of lost, stolen, or copied keys, an authorized combination may be forgotten, preventing access to the locked item by the authorized user. Further, in a situation where an administrator or other such individual needs access to the locked item or items, it may be difficult or impossible to keep track of the authorized combinations, particularly where the combination code is changeable by the user.

SUMMARY OF THE DISCLOSURE

In accordance with an inventive aspect of the present application, a multiple-dial combination lock may be provided with a mechanism or arrangement for identifying the authorized combination code corresponding to an unlocking orientation of the dials. The code identifying arrangement may be movable between a code concealing position and a code identifying position, for example, through use of a key-operated mechanism and a proper key, to prevent unauthorized users from learning the combination code. When the code identifying arrangement is in the code identifying position, rotation of each dial to its unlocking orientation provides a perceptible indication that the unlocking orientation has been reached.

Accordingly, in one exemplary embodiment, a combination lock includes a locking mechanism, a plurality of dials, and a code identifying member. When each of the plurality of dials is rotated to an unlocking orientation, a recess on each of the dials aligns with a portion of the locking mechanism, allowing the locking mechanism to move from a locked condition to an unlocked condition. When the code identifying member is in a dial engaging position, and one of the plurality of dials is rotated to the unlocking orientation, one of a plurality of dial engaging portions of the code identifying member engages the recess of the one of the plurality of dials to provide a perceptible indication that the one of the plurality of dials is in the unlocking orientation.

BRIEF DESCRIPTION OF THE DRAWINGS

Further features and advantages of the invention will become apparent from the following detailed description made with reference to the accompanying drawings, wherein.

DETAILED DESCRIPTION OF THE INVENTION

The present application relates to combination lock arrangements that may be used with many different types of locks, such as, for example, combination padlocks, safe locks, and integral locks for lockers, mailboxes, storage sheds, or other such structures and enclosures. While the embodiments described in the present application refer to a multiple-dial combination padlock, the inventive aspects described herein may be applied to any type of lock incorporating any number of combination dials. This Detailed Description merely describes exemplary embodiments and is not intended to limit the scope of the claims in any way. Indeed, the invention as described is broader than and unlimited by the described embodiments, and the terms used have their full ordinary meaning.

According to one aspect of the present application, a multiple-dial combination lock utilizing a mechanical locking mechanism, such as, for example, a shackle lockably engaged by one or more locking members (for example, ball bearings), may be provided with a code identifying arrangement that allows an authorized user or administrator to ascertain the combination code for the lock. When the code identifying arrangement is operated or moved to a code identifying position, rotation of each dial to its unlocking orientation provides a perceptible indication that the unlocking orientation has been reached. The code identifying arrangement may be configured to provide many different types of perceptible indications of the unlocking orientation, including, for example, audible indicators (such as a click or beep), visual indicators (such as a light), or tactile indicators (such as a resistance to rotation or impeded rotation in one or both directions).

Figure 1:
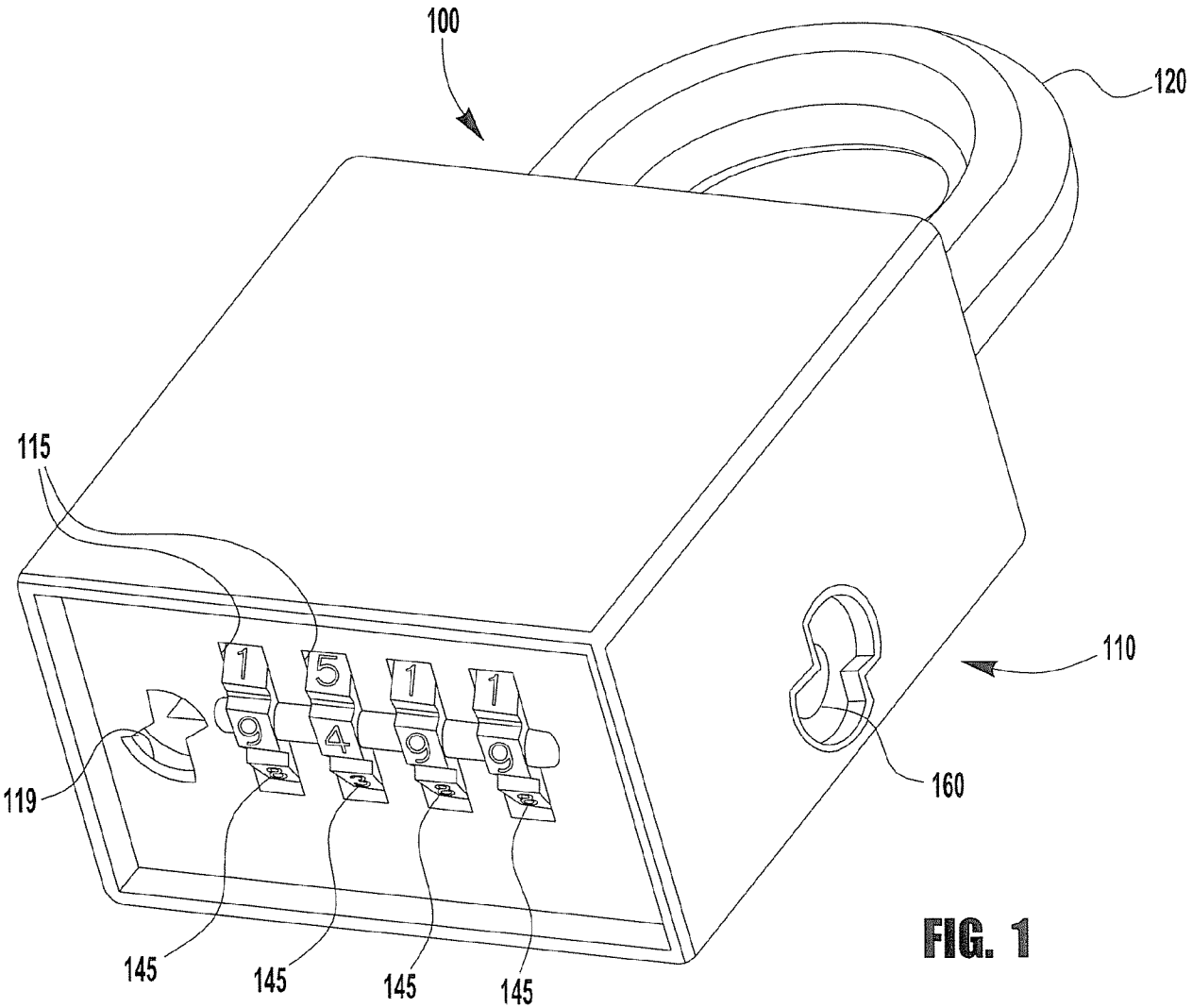
FIG. 1 is a perspective view of a combination lock.

Referring now to the drawings, FIGS. 1-7 illustrate an exemplary embodiment of a multiple-dial combination padlock 100 having a key operated code identifying arrangement. As shown in FIG. 1, the exemplary padlock 100 includes a lock body 110 configured to retain a shackle 120, and a series of wheels 145, partially exposed through openings 115 in the lock body 110 to allow user rotation of the wheels 145. The exemplary lock body 110, as shown in the exploded view of FIG. 2, includes a housing 111, top plate 112, outer casing 113, and wedge plate 114, which define cavities within the lock body for accommodating the internal components of the lock 100.

Figure 3:
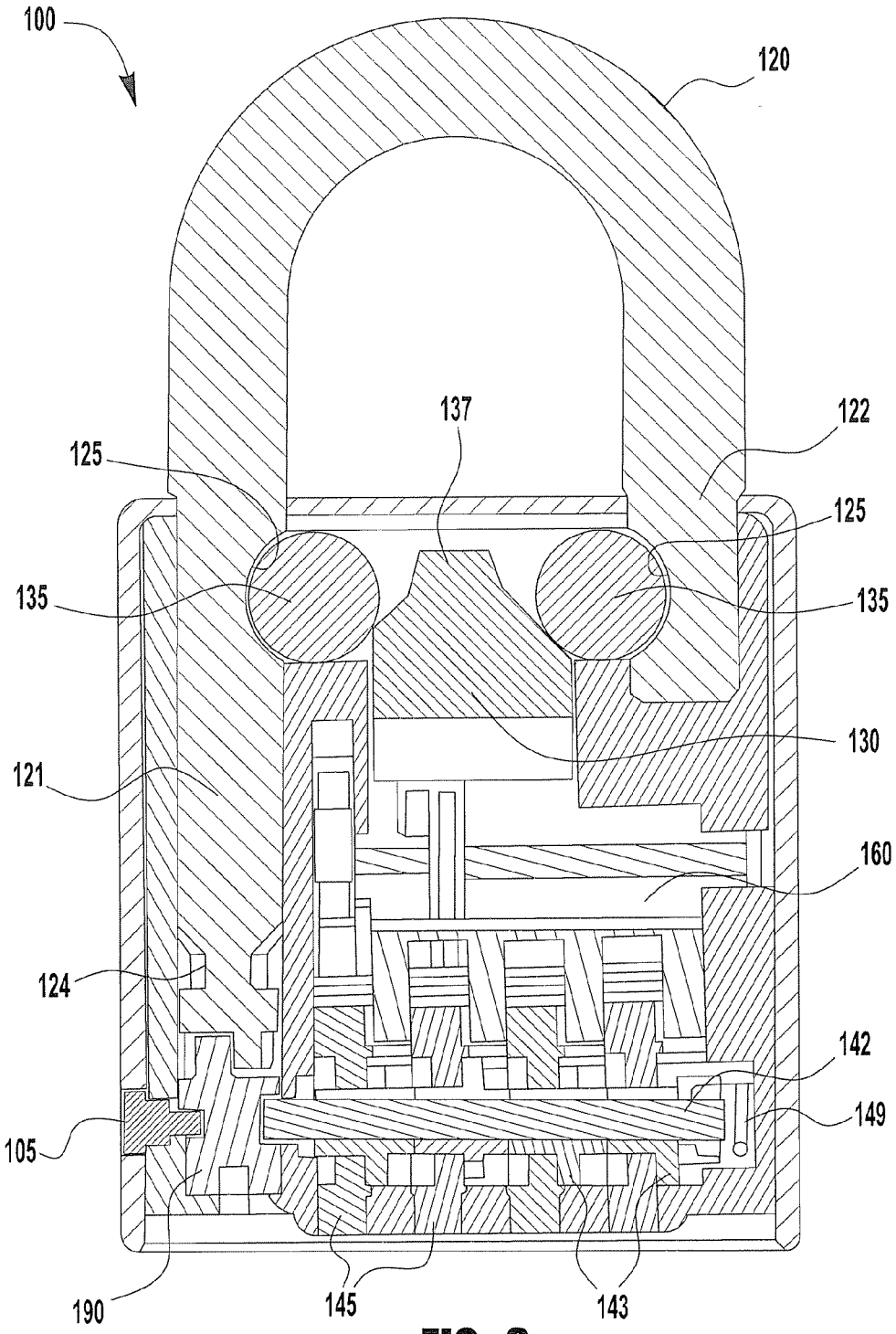
FIG. 3 is a front cross sectional view of the combination lock of FIG. 1.

The exemplary lock 100 includes a locking mechanism, discussed in greater detail below, that releases the shackle 120 from a locked condition when each of the wheels 145 is rotated to an unlocking orientation. While the illustrated wheels 145 include number markings to identify the rotational orientation of each wheel, any types of markings may be used (including, for example, letters, pictures, and colors). While many different locking mechanisms may be employed, in the illustrated embodiment, the shackle 120 is secured in a locked condition within the lock body 110 by a blocker 130, which forces locking members 135 into engagement with corresponding notches 125 (as shown in FIG. 3) in the shackle 120 when the blocker 130 is in an extended or locked condition, thereby preventing axial movement of the shackle 120.

A dial assembly 140 is disposed within the lock body 110 of the exemplary lock 100, and includes a series of wheels 145 and hubs 143 rotatable about a post 142. Each of the wheels 145 engages a corresponding hub 143 on its inner diameter (for example, using interlocking gear teeth), such that each of the wheels 145 engages with one of the hubs 143 to rotate together as a series of dials. The lock 100 may further include a spring detent plate 147 (see FIGS. 2 and 6) to hold the wheels 145 in place in one of several set positions (for example, the numbered "0" through "9" positions on a conventional lock dial) when the wheels are not being manually rotated by a user.

Figure 2:
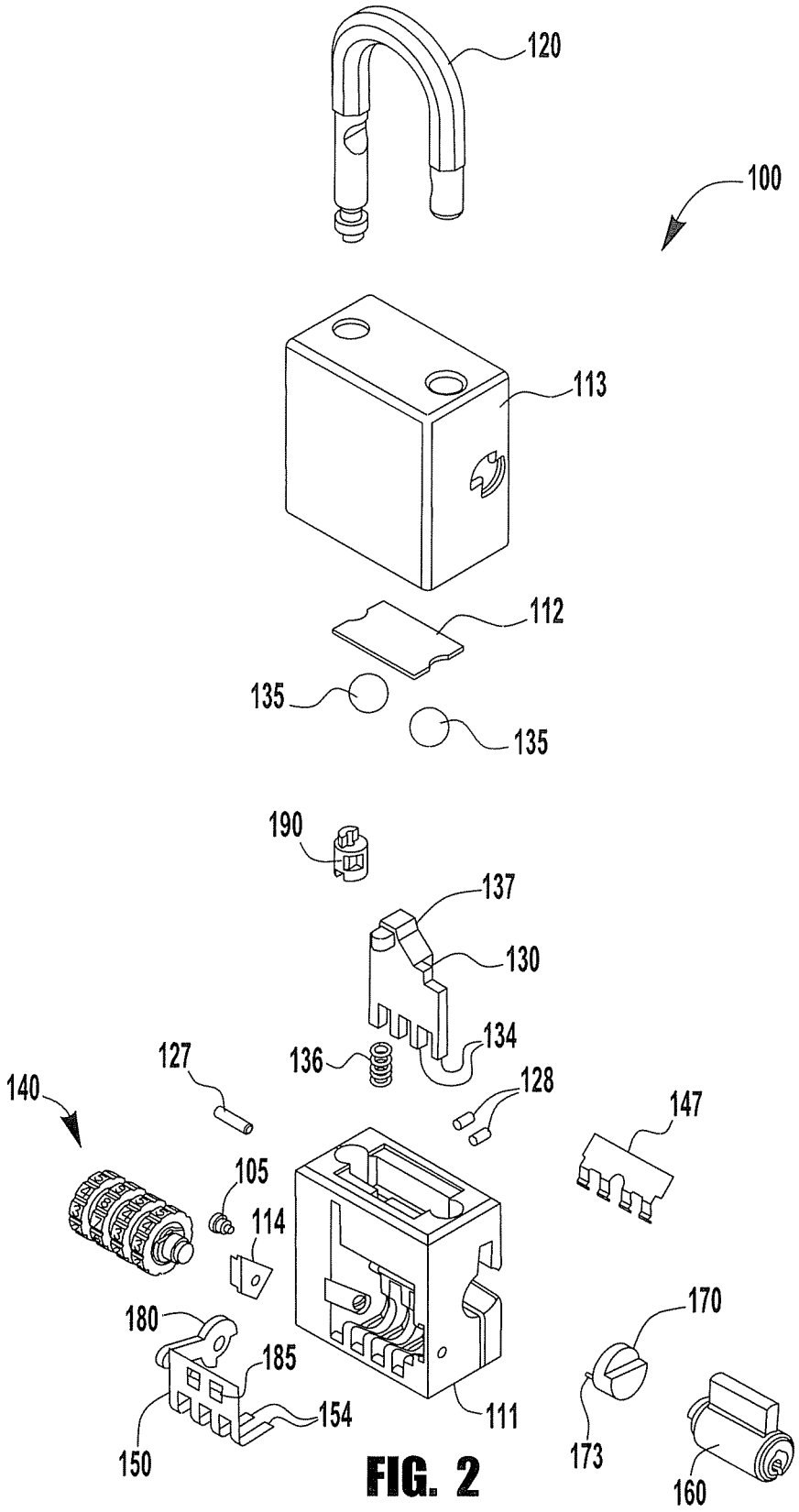
FIG. 2 is an exploded perspective view of the combination lock of FIG. 1.
Figure 4:
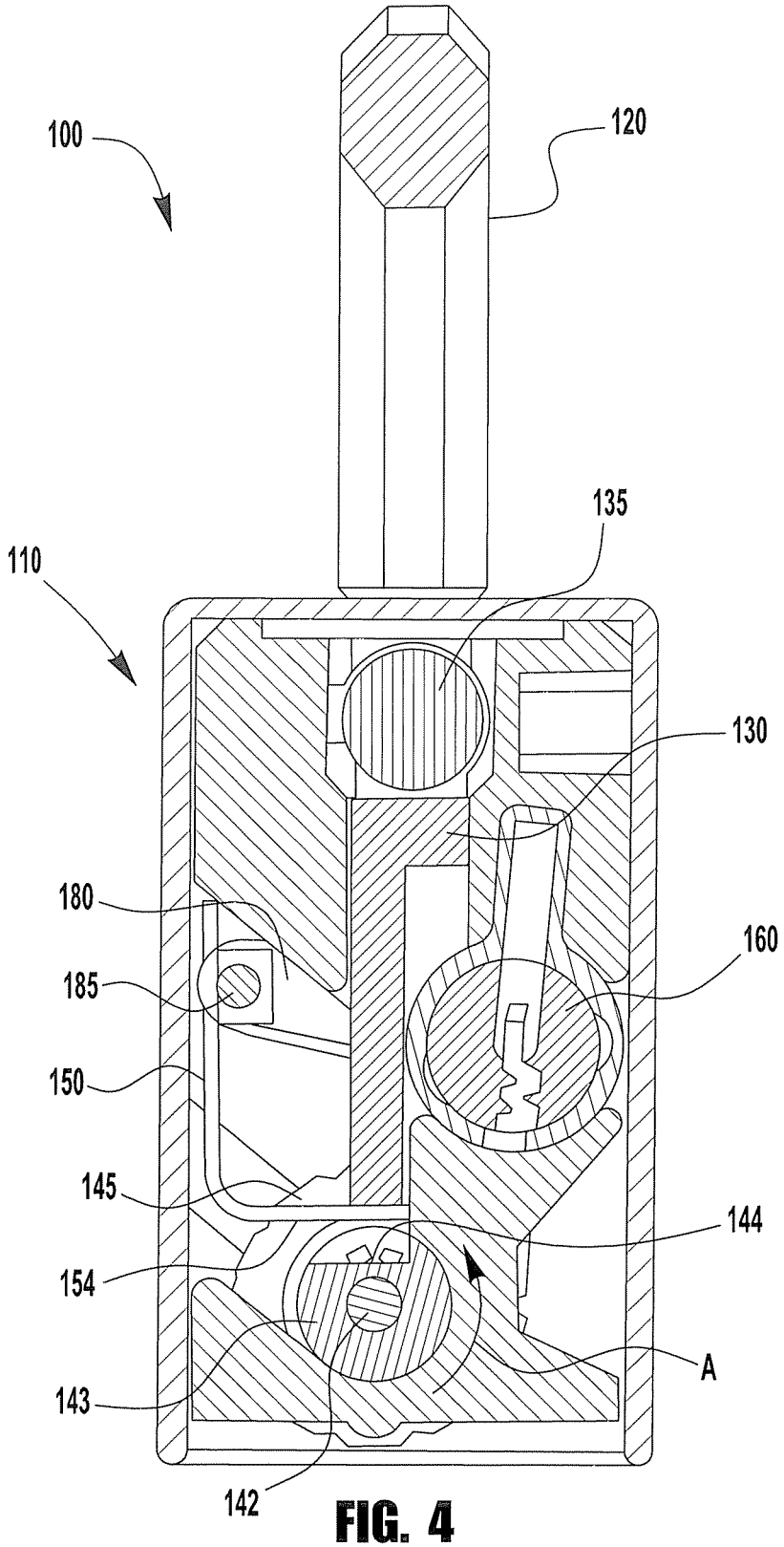
FIG. 4 is a side cross sectional view of the combination lock of FIG. 1.
Figure 5:
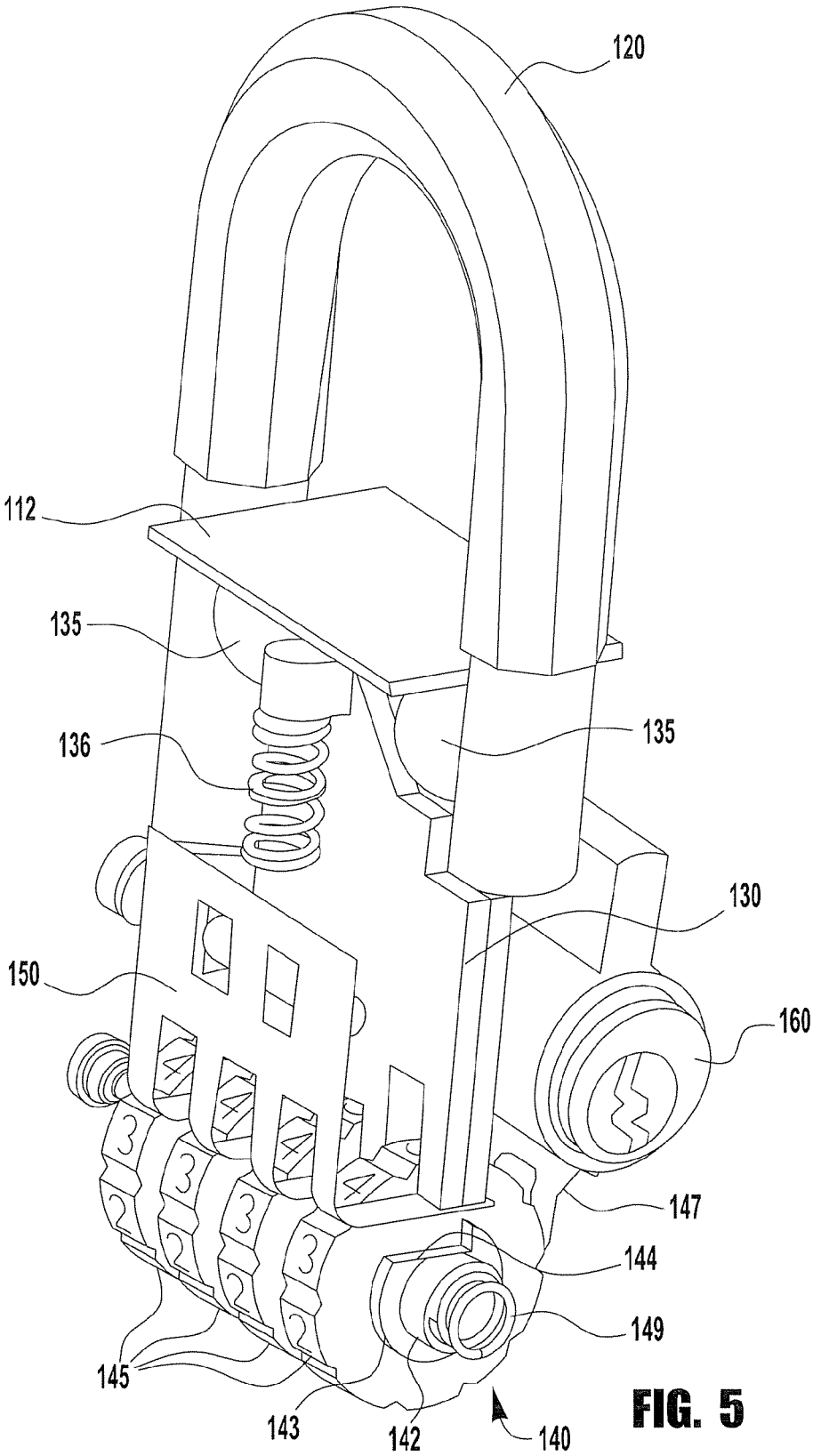
FIG. 5 is a perspective view of the internal lock components of the combination lock of FIG. 1.
Figure 6:
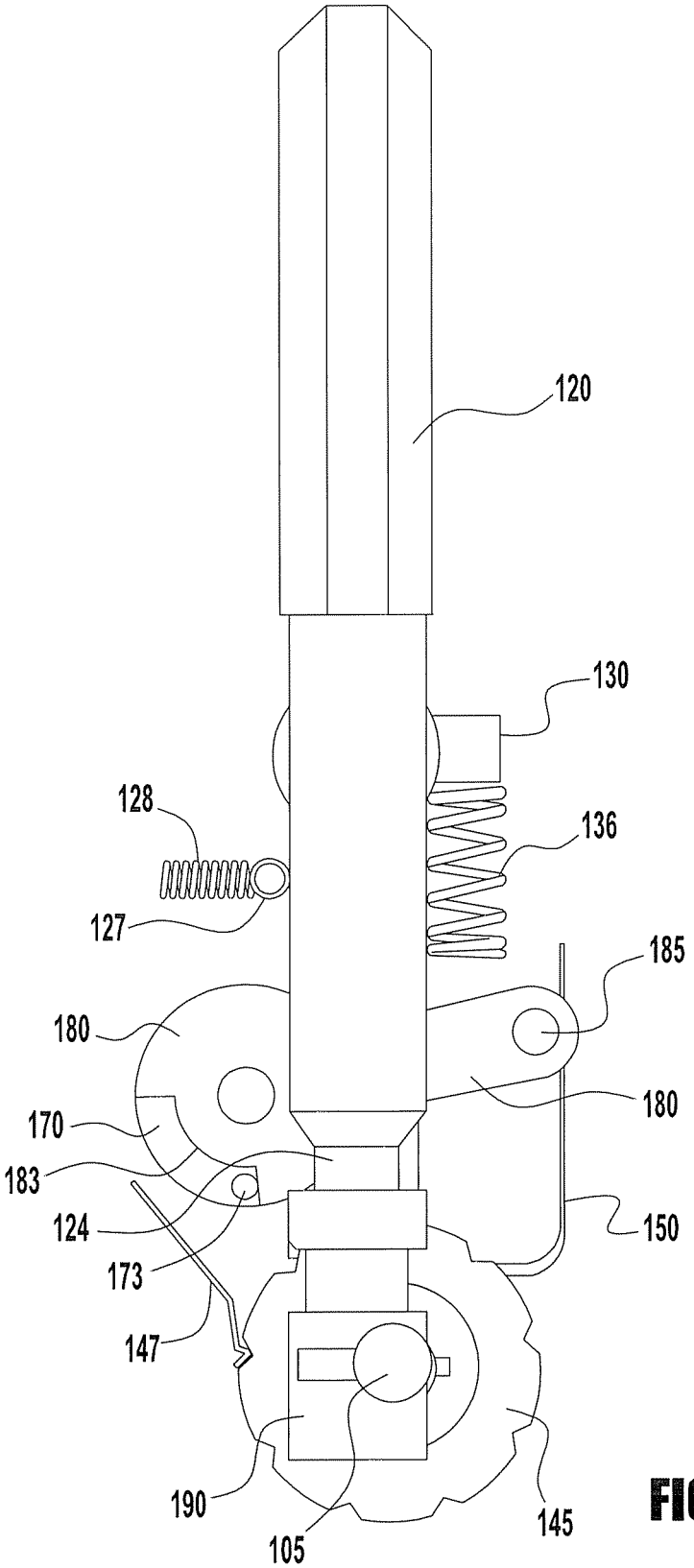
FIG. 6 is a side view of the internal lock components of the combination lock of FIG. 1.

Each of the hubs 143 includes an unlocking feature, such as, for example, a recess 144 (shown in FIG. 4), disposed on an outer periphery of the hub 143. Other types of unlocking features may be utilized, including, for example, notches, ramps, or projections. When the recesses 144 are aligned with dial contacting portions 134 of the blocker 130 (which may, for example, include finger-like extensions, as shown in FIG. 2), the exemplary blocker 130 becomes axially movable from the extended or locked condition to the retracted or unlocked condition, with the dial contacting portions 134 being received in engagement with the recesses 144. In the unlocked condition, a narrow end portion 137 of the blocker 130 axially aligns with the locking members 135, allowing the locking members 135 to disengage from the shackle notches 125, thereby allowing the shackle 120 to be axially extended from the lock body 110 to disengage the short leg 122 of the shackle 120 from the lock body 110. As shown in FIGS. 2 and 5, a biasing spring 136 may be disposed between the blocker 130 and the housing 111 to bias the blocker 130 toward the locked condition, such that the shackle 120 must be pulled to force the locking members 135 inward and the blocker 130 downward. While many different configurations may be used to retain the long leg 121 of the shackle 120 in the lock body 110 in this unlocked condition, in the illustrated embodiment, a shackle pin 127 biased by springs 128 engages a groove 124 near the end of the long leg 121 to prevent the long leg 121 from disengaging from the lock body 110.

To identify or ascertain the proper combination code of a multiple dial combination lock, a code identifying or dial engaging mechanism may be included in the lock and movable between a code concealing (or dial disengaged) position and a code identifying (or dial engaging) position. In the code identifying position, the dial engaging mechanism is positioned to independently engage each of the dials, such that a perceptible indication is provided when each of the dials is rotated to an unlocking orientation. To provide for independent engagement with each of the dials, the dial engagement mechanism may be provided with a series of resilient pins, tabs, or other such components configured to move independent of each other.

In the illustrated embodiment, the code identifying mechanism includes a spring plate 150 having a body and resilient tabs 154 or dial engaging portions that extend from the body to align with and correspond to each of the hubs 143. For example, in the embodiment shown in the Figures there are four hubs 143, with one hub corresponding to each of the wheels 145. When the body of the spring plate 150 is moved to a code identifying or dial engaging position, the tabs 154 flex against the outer peripheries of the hubs 143. When one of the dials 140 is rotated to the unlocking orientation, the corresponding flexed tab 154 snaps into engagement with the recess 144 to provide an indication that the unlocking orientation has been reached. While different types of engagement may be used to provide different perceptible indications (such as, for example, a click-type detent or electrical connectivity between the hub and the dial engaging mechanism), in one embodiment, the recess (or other such unlocking feature) 144 and the tab (or other such dial engaging feature) 154 may be configured to provide stopping engagement or impeded movement of the dial in one or both rotational directions. In the illustrated embodiment, as shown in FIG. 4, upon engagement of the tab 154 with the recess 144, rotation of the wheel 145 is impeded in the direction identified by arrow A. Therefore, to identify the proper combination code, each wheel 145 may be rotated in the direction A until rotation is impeded.

While a dial engaging member (such as a spring plate) may be provided in many different orientations and positions within the lock, in the illustrated embodiment, the spring plate 150 is positioned between the blocker 130 and the dial assembly 140, such that movement of the blocker 130 to the unlocking condition moves the spring plate tabs 154 into engagement with the recesses 144, regardless of whether the spring plate 150 is in the dial disengaged position or the dial engaging position. In other embodiments (not shown), dial contacting portions of the dial engaging member may be provided in some other orientation for engagement with the unlocking features. In still other embodiments (not shown), a set of dials may be provided with a first set of unlocking features for engaging the locking mechanism (such as a blocker) and a second set of unlocking features for engaging the dial engaging member (such as a spring plate), where alignment of the first set of unlocking features with the locking mechanism corresponds with alignment of the second set of unlocking features with the dial engaging member, for identification of the combination code when the dial engaging member is in the code identifying position.

Many different mechanisms or configurations may be utilized to allow an authorized user or administrator to move the dial engaging mechanism from the code concealing position to the code identifying position for identification of the combination code, including, for example, key-operated mechanisms, master code combinations (with wheels configured to move a dial engaging mechanism to a code identifying position when in a predetermined "master" combination), or electronically operated mechanisms (such as an electronic key card or an infrared or radio frequency transmitter and receiver). In the illustrated embodiment, a key-operated pin tumbler cylinder 160, as shown in the art, extends from a side of the lock body 110, and is operable (with a proper key) to move the spring plate 150 into the dial engaging position. While many different operative connections may be provided between the key operated cylinder 160 and the spring plate 150, in the illustrated embodiment, an inner end of the cylinder 160 engages a disc-shaped cam 170, which is rotatable to pivot (via pin 173) a drive arm 180 connected with the spring plate 150 by pin 185 for movement of the spring plate 150. Because the drive arm 180 and spring pin 150 need only move a short distance for movement from the dial disengaged position to the dial engaging position and the convention key cylinder rotates approximately 90° with a proper key, the drive arm 180 may be provided with an extended recess or slot 183 (see FIG. 6), such that 90° rotation of the cam 170 results in reduced rotation (for example, approximately 15°) of the drive arm 180. The lock 100 may be configured to use a conventional key cylinder, consistent with a door key cylinder, such that an authorized user may use his or her house key to identify the combination code on the combination lock.

Figure 7:
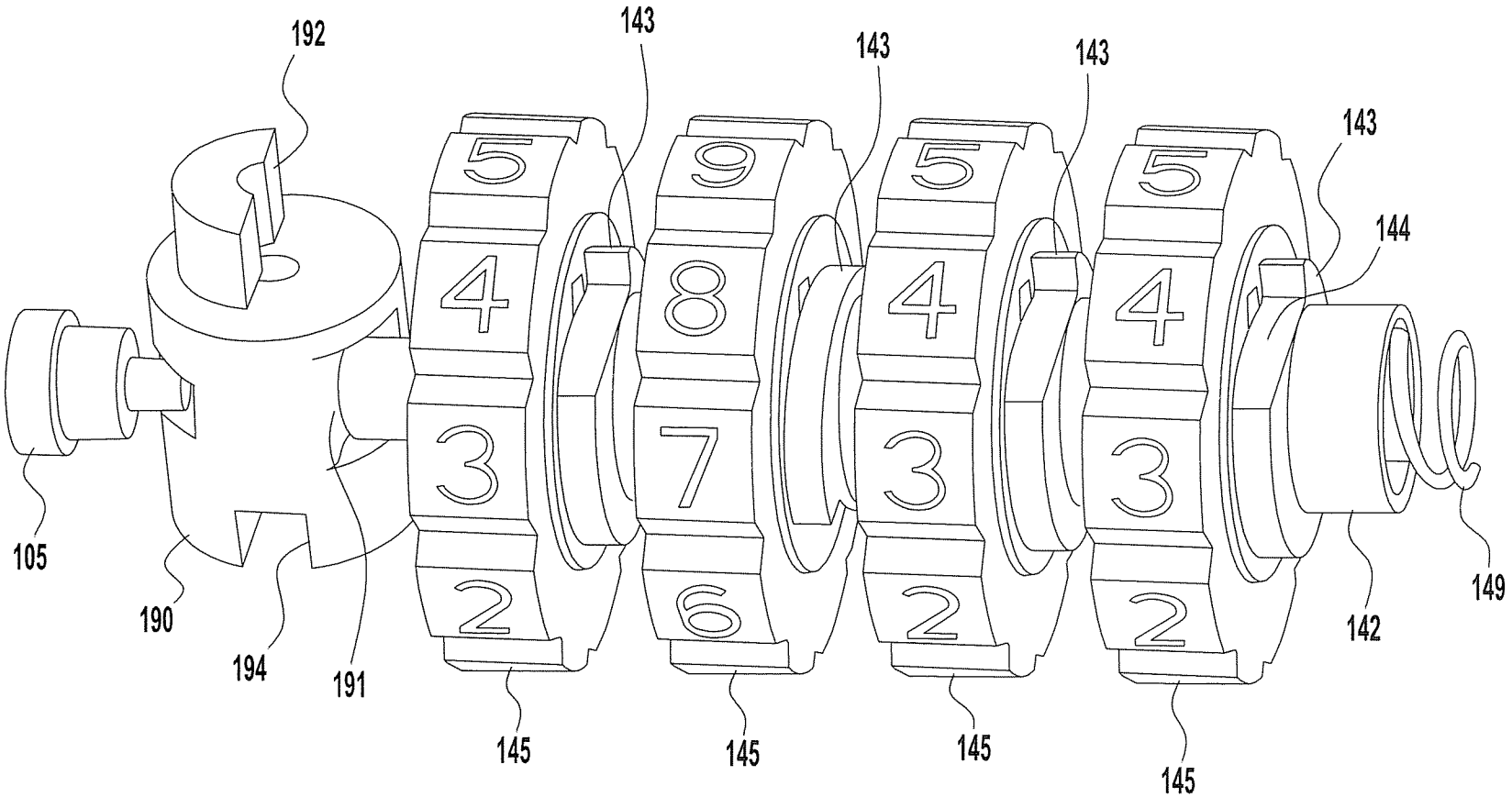
FIG. 7 is a perspective view of the dial assembly and code change mechanism of the combination lock of FIG. 1.

The exemplary lock 100 is also configured to allow an authorized user to change the combination code upon unlocking the lock. As best seen in FIG. 7, a code change member 190 is disposed in the lock body 110 and accessible through an opening 119 (see FIG. 1) in the bottom of the lock body 110. The code change member 190 includes a contoured surface 191 that engages the post 142. When the shackle 120 is locked, the end of the long leg 121 engages a stepped end 192 of the code change member 190 to prevent movement of the code change member. When the lock 100 is unlocked and the shackle 120 is lifted, the code change member 190 may be rotated (for example, by a screwdriver inserted in a slot 194 in the exposed end) such that the contoured surface 191 axially pushes the post 142 and hubs 143, disengaging the hubs 143 from the wheels 145. Upon disengagement of the hubs 143 from the wheels 145, the wheels 145 may be rotated to a new authorized combination. Once the new combination has been set, the code change member 190 may be returned to the original position, and a biasing spring 149 returns the post 142 and hubs 143 to reengage the hubs 143 with the wheels 145. A fastener or pin 105 used to secure the outer casing 113 to the housing 111 may also retain the code change member 190 at the base of the housing 111.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative indicators and ranges may be included to assist in understanding the present disclosure; however, such indicators and ranges are not to be construed in a limiting sense and are intended to be critical indicators or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

I claim:

1. A dial code combination identifying lock comprising:

a lock body;

a plurality of dials assembled with the lock body, each comprising an unlocking feature, each of the plurality of dials being rotatable to an unlocking orientation;

a locking mechanism disposed within the lock body and movable between a locked position and an unlocked position when all of the plurality of dials are in the unlocking orientation;

a shackle having a long leg retained within the lock body and a short leg lockably securable within the lock body when the locking mechanism is in the locked position, and separable from the lock body in an axial direction along an axis defined by the long leg when the locking mechanism is in the unlocked position; and a user operable code identifying mechanism movable between a code concealing condition and a code identifying condition while the shackle remains secured in the locked position, the code identifying mechanism comprising a plurality of dial engaging members each biased into engagement with the corresponding dial when the code identifying mechanism is in the code identifying condition, such that rotation of any one of the dials to the unlocking orientation causes the corresponding dial engaging member to engage the corresponding unlocking feature to provide a positive perceptible indication that the corresponding dial is only in the unlocking orientation independent of orientations of the other dials;

wherein the unlocking features comprise recesses on outer peripheries of each of the plurality of dials; and wherein the locking mechanism comprises a blocking member slideable in the axial direction between the locked and unlocked positions, with each of the plurality of dial engaging members being configured to hold the blocking member in the locked position, further wherein when each of the plurality of dials is rotated to the unlocking orientation, each of the corresponding recesses aligns with each of the corresponding ones of the plurality of dial engaging members, allowing the blocking member to slide in the axial direction from the locked position to the unlocked position.

2. The lock of claim 1, wherein the perceptible indication comprises impeded rotation of the dial in both directions beyond the unlocking orientation.

3. The lock of claim 1, wherein the user operable code identifying mechanism comprises a key-operated mechanism rotatable to move the code identifying mechanism from the code concealing position to the code identifying position while the locking mechanism remains in the locked position.

4. The lock of claim 3, further comprising a pivotable camming lever configured to translate rotational movement of the key operated mechanism to axial movement of the dial engaging members.

5. A code identifying combination lock comprising:

a lock body;

a plurality of user rotatable dials assembled with the lock body, each including an unlocking feature;

a shackle having a long leg retained within the lock body and a short leg separable from the lock body in an axial direction along an axis defined by the long leg;

a blocker disposed within the lock body and comprising a plurality of dial engaging members configured to hold the blocker in a locking position, wherein when each of the plurality of dials is rotated to an unlocking orientation, each of the corresponding unlocking features aligns with each of the corresponding ones of the plurality of dial engaging members, allowing the blocker to slide in the axial direction from the locking position to an unlocking position to permit separation of the short leg of the shackle from the lock body; and a code identifying member assembled with the blocker, the code identifying member being movable between a code concealing condition and a code identifying condition;

wherein when the code identifying member is in the code identifying condition, each of the plurality of dial engaging members is in biased engagement with the plurality of dials, such that rotation of any one of the plurality of dials to the unlocking orientation causes the corresponding dial engaging member to engage the corresponding unlocking feature to provide a positive perceptible indication that the one of the plurality of dials is only in the unlocking orientation independent of orientations of the other dials.

6. The combination lock of claim 5, wherein the perceptible indication comprises impeded rotation of the dial in both directions beyond the unlocking orientation.

7. The combination lock of claim 5, further comprising a key-operated mechanism configured to move the code identifying member from the code concealing condition to the code identifying condition.

8. The combination lock of claim 7, further comprising a pivotable camming lever configured to translate rotational movement of the key operated mechanism to axial movement of the code identifying member in a direction substantially perpendicular to a rotational axis of the plurality of dials.

9. The combination lock of claim 5, wherein each of the plurality of dials comprises a hub including the unlocking feature and a user rotatable wheel, the hub being separable from the wheel to change the rotational orientation of the wheel with respect to the hub, thereby changing the unlocking orientation of the dial.

10. The combination lock of claim 9, further comprising a code changing member accessible from outside the lock, wherein movement of the code changing member axially separates the hubs from the corresponding wheels.

* * * * *